US007510023B1

(12) United States Patent
Cheng

(10) Patent No.: US 7,510,023 B1
(45) Date of Patent: Mar. 31, 2009

(54) IMPACT ASSEMBLY FOR A POWER TOOL

(75) Inventor: Ming-Ta Cheng, Miaoli Hsien (TW)

(73) Assignees: Kuani Gear Co., Ltd., Hsin Chuang, Taipei Hsien (TW); Hsin-Chung Lin, Taipei (TW)

( * ) Notice: Subject to any disclaimer, the term of this patent is extended or adjusted under 35 U.S.C. 154(b) by 0 days.

(21) Appl. No.: 11/963,643

(22) Filed: Dec. 21, 2007

(51) Int. Cl.
*B25B 21/02* (2006.01)

(52) U.S. Cl. ..... 173/93.5; 173/93

(58) Field of Classification Search ..... 173/93, 173/93.5, 93.6, 104, 109, 176, 205
See application file for complete search history.

(56) References Cited

U.S. PATENT DOCUMENTS 3,557,884 A * 1/1971 Allen ..... 173/93.5
4,287,956 A * 9/1981 Maurer ..... 173/93.5
4,313,505 A * 2/1982 Silvern ..... 173/93.5
5,906,244 A * 5/1999 Thompson et al. ..... 173/93.5
6,024,180 A * 2/2000 Lin ..... 173/93.5
6,070,674 A * 6/2000 Williamson et al. ..... 173/1
6,491,111 B1 * 12/2002 Livingston et al. ..... 173/93.5
6,648,080 B1 * 11/2003 Liao ..... 173/93.5
7,182,149 B2 * 2/2007 Chang ..... 173/93.5
7,331,404 B2 * 2/2008 Pusateri ..... 173/93.5

* cited by examiner

*Primary Examiner*—Scott A. Smith
(74) *Attorney, Agent, or Firm*—pattenttm.us

(57) ABSTRACT

An impact assembly is used for a power tool having a chamber, a handle and a rotary driver mounted in the chamber near the handle and having a driving shaft. The impact assembly has a hammer frame, at least one hammer, two hammer pins and an output axle. The hammer frame is connected to the rotary driver and has a mounting recess, a driver mount and a through hole. The at least one hammer is pivotally mounted in the mounting recess and each hammer has an engaging hole, a loosening protrusion and a tightening protrusion. The hammer pins are mounted in the hammer frame to pivotally connect each hammer to the hammer frame. The output axle is mounted in the hammer frame and the engaging hole of each hammer and protrudes out of the through hole.

5 Claims, 9 Drawing Sheets

IMPACT ASSEMBLY FOR A POWER TOOL

BACKGROUND OF THE INVENTION

1. Field of the Invention

The present invention relates to an impact assembly, and more particularly to an impact assembly for a power tool that prevents stripping heads of bolts and nuts.

2. Description of Related Art

Conventional power tools are used to tighten or loosen bolts and nuts, and usually comprise single or dual impact assemblies.

With reference to FIG. 9, a conventional impact assembly (50) for a power tool in accordance with the prior art comprises a hammer frame (51), two hammer pins (53), two hammers (52) and an output axle (60). The hammer frame (51) is mounted in the power tool and is connected to and rotated by a rotary driver of the power tool. The hammer pins (53) are parallelly mounted in the hammer frame (51). The hammers (52) are mounted in the hammer frame (51) and respectively engage the hammer pins (53) and each hammer (52) has a center, an engaging hole (521) and two impact protrusions (522). The engaging hole (521) is defined through the center of the hammer (52) and has an inner surface. The impact protrusions (522) are formed on the inner surface of the engaging hole (521) in the hammer (52). The output axle (60) is mounted in the hammer frame (51) and is disposed through the engaging holes (521) in the hammers (52) and has an external surface and two anvils (61). The anvils (61) are formed on the external surface of the output axle (60) and correspond to the impact protrusions (522) in the engaging holes (521) of the hammers (52).

When the conventional power tool is used, the rotary driver is rotated to drive the hammer frame (51) to rotate. Because the hammer pins (53) are connected between the hammer frame (52) and the hammers (52), the hammers (52) will rotate with the hammer (51). The impact protrusions (522) in the engaging holes (521) of the hammers (52) respectively engage the anvils (61) on the output axle (60) synchronously. Consequently, the output axle (60) will be driven to rotate with the hammer frame (51) at high intermittent torque. A tool head sleeve is further mounted on the output axle (60) to loosen the fastener.

When changing or maintaining a vehicle wheel, the conventional power tool is implemented, having a same or higher maximum pounds of torque than specifications or regulations regarding the fastener, to adjust the bolts and nuts. The conventional power tool is operated several times to adjust the bolts and nuts to correct specifications and when tightening, this may cause the head to be over-torqued and stripped. Furthermore, since the power tool delivers an unknown torque, when tightening the fastener, the fastener may not meet safety standards, laws or regulations for each country.

To overcome the shortcomings, the present invention tends to provide an impact assembly to mitigate or obviate the aforementioned problems.

SUMMARY OF THE INVENTION

The main objective of the present invention is to provide an impact assembly for a power tool that prevents stripping heads of bolts and nuts.

The impact assembly in accordance with the present invention for a power tool having a chamber, a handle and a rotary driver mounted in the chamber near the handle having a driving shaft. The impact assembly comprises a hammer frame, at least one hammer, two hammer pins and an output axle. The hammer frame is connected to the rotary driver in the shell and has a mounting recess, a driver mount and a through hole. The at least one hammer is pivotally mounted in the mounting recess and each hammer has an engaging hole, a loosening protrusion and a tightening protrusion. The hammer pins are mounted in the hammer frame to pivotally connect each hammer to the hammer frame. The output axle is mounted in the hammer frame and engaging hole of each hammer and protrudes out of the through hole.

Because the tightening protrusions are smaller than the loosening protrusions the anvils of the output axle do not fully engage the tightening protrusions. Therefore, maximum pounds of torque during tightening is lower than maximum pounds of torque during loosening.

Therefore, when implemented for adjusting wheel nuts or bolts, the wheel nut or bolt cannot be over-tightened even if the user operates the power tool several times, so prevents head stripping. Since the wheel nut or bolt is not tightened, a torque wrench must be used to tighten the wheel nut or bolt to specification, laws or regulations for each country and is therefore safer.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
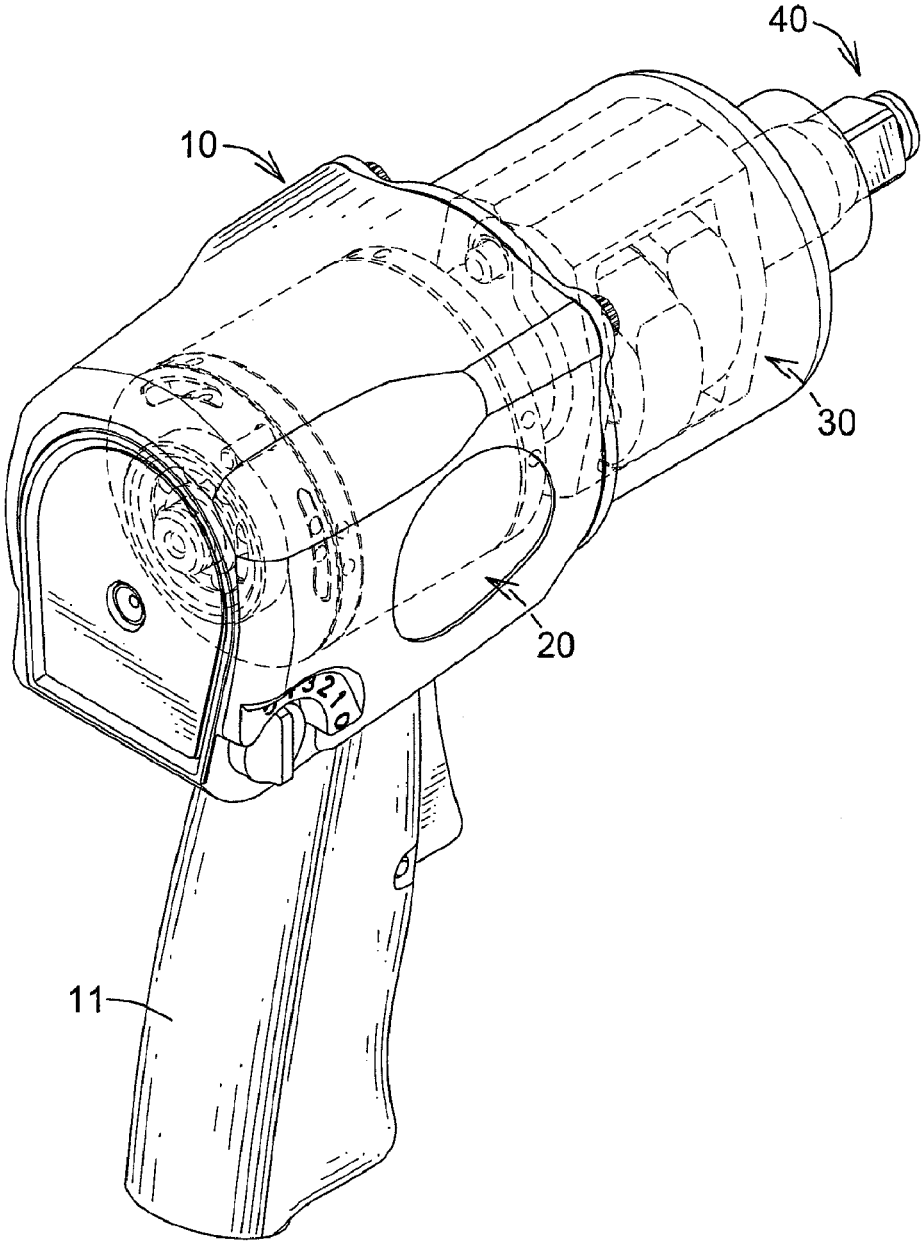
FIG. 1 is a perspective view of an impact assembly in accordance with the present invention shown in phantom line mounted in a power tool.
Figure 2:
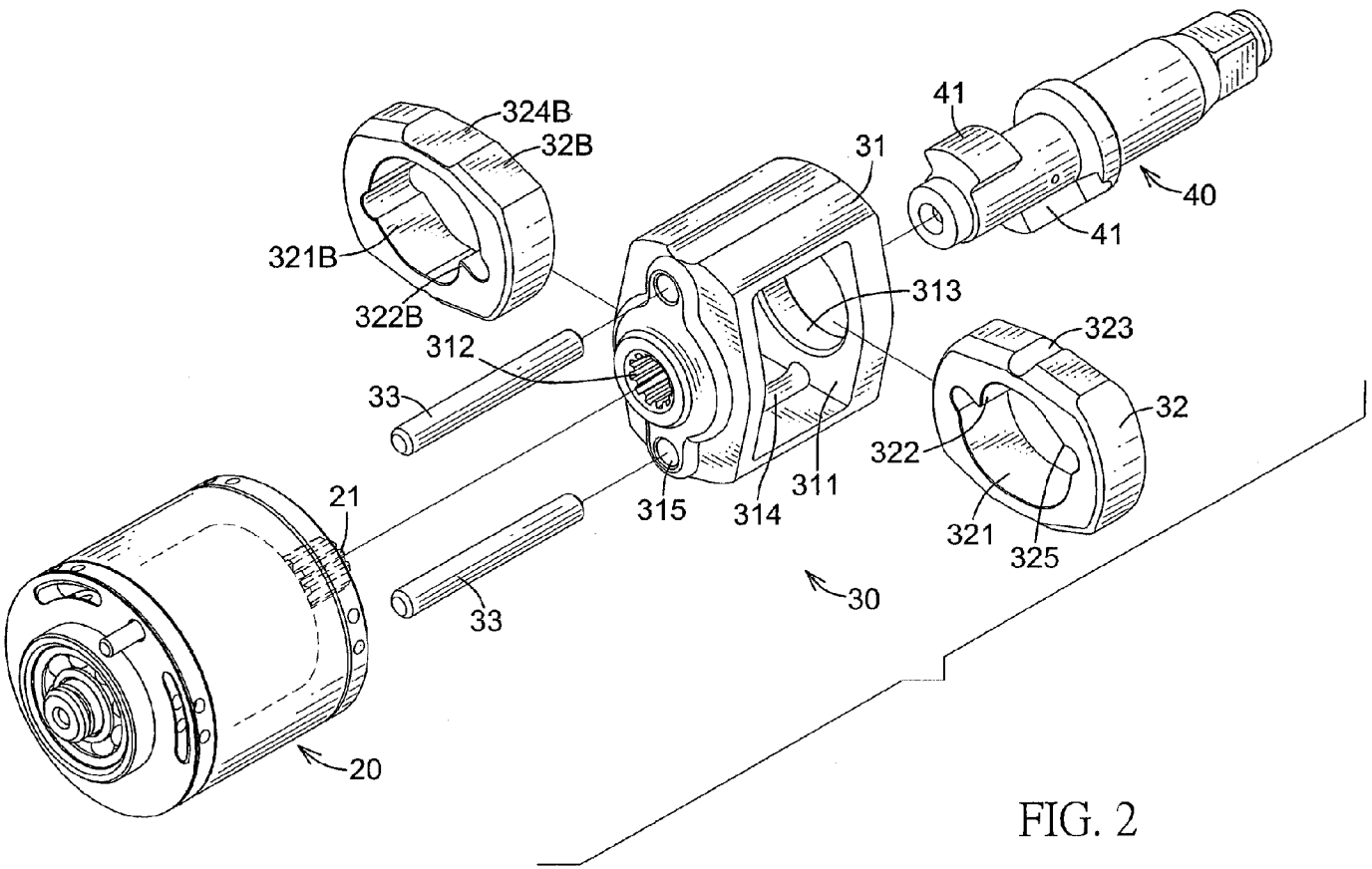
FIG. 2 is an exploded perspective view of the impact assembly in FIG. 1.

With reference to FIGS. 1, 2, 7 and 8, an impact assembly (30) in accordance with the present invention for a power tool having a chamber (10), a handle (11) and a rotary driver (20) being mounted in the chamber near the handle (11), the rotary driver (20) having a driving shaft (21) and may have multiple teeth formed on the driving shaft (21). The impact assembly (30) comprises a hammer frame (31), at least one hammer (32, 32B, 32A), two hammer pins (33) and an output axle (40, 40A).

The hammer frame (31) is mounted rotatably in the chamber (10) of the power tool, is connected to the rotary driver (20) and has a front wall, a rear wall, a mounting recess (311), an optional driver mount (312), a through hole (313) and two optional pin mounts (315). The mounting recess (311) is formed in the hammer frame (31) between the walls and has two opposite inner sides. The driver mount (312) is formed centrally in the rear wall of the hammer frame (31) and is adapted to connect to the driving shaft (21) of the rotary driver (20) and may have multiple connecting teeth engaging the teeth of the driving shaft (21) to ensure the hammer frame (31) rotates securely with the rotary driver (20). The through hole (313) is formed centrally in the front wall of the hammer frame (31) and may be aligned with the driver mount (312). The pin mounts (315) are formed through the rear wall of the hammer frame (31) and may be further formed respectively in the inner sides of the mounting recess (311).

Each hammer (32, 32B, 32A) is mounted pivotally in the mounting recess (311) of the hammer frame (31) between the walls, two hammers (32, 32B) may be inversely mounted in the hammer frame (31) and each hammer (32, 32B) has a center, an external surface, an engaging hole (321, 321B), a loosening protrusion (322, 322B), an optional engaging groove (323, 323B), an optional sliding recess (324, 324B) and a tightening protrusion (325, 325B). The engaging hole (321, 321B) is defined through the center of the hammer (32, 32B, 32A) and has an inner surface. The loosening protrusion (322, 322B) is formed on the inner surface of the engaging hole (321, 321B) in the hammer (32, 32B, 32A). The engaging groove (323, 323B) is formed on the external surface of the hammer (32, 32B, 32A) and aligns with a corresponding pin mount (315). The sliding recess (324, 324B) is formed on the external surface of the hammer (32, 32B) opposite to the engaging groove (323, 323B) and is mounted slidably on a corresponding pin mount (315). The tightening protrusion (325, 325B) is formed on the inner surface of the engaging hole (321, 321B) of the hammer (32, 32B) and is smaller than the loosening protrusion (322, 322B).

The hammer pins (33) are mounted in the hammer frame (31) to pivotally connect each hammer (32, 32B, 32A) to the hammer frame (31) and are mounted respectively in the pin mounts (315), the sliding recess (324, 324B) and the engaging groove (323, 323B) of the hammer (32, 32B) to allow each hammer (32, 32B) to rock. When two hammers (32, 32B) are implemented, each hammer pin (33) is mounted in one sliding recess (324, 324B) and one engaging groove (323, 323B) of the hammers (32, 32B).

The output axle (40, 40A) is mounted in the hammer frame (31), and the engaging hole (321, 321B) of each hammer (32, 32B, 32A) and protrudes out through the through hole (313) and has an external surface, a hammer end, an outer end and at least one anvil (41). The at least one anvil (41) is formed on the external surface of the output axle (40, 40A) near the hammer end to selectively abut the loosening and tightening protrusions (322, 322B, 325, 325B). When two hammers (32, 32B) are implemented, two anvils (41) are implemented, being oppositely formed on and diametrically protruding staggered from the external surface of the output axle (40) to respectively abut selectively the loosening protrusions (322, 322B) and tightening protrusions (325, 325B) of the hammers (32, 32B). A tool head sleeve is detachably mounted on the outer end of the output axle (40, 40A) for attaching detachable sockets or screwdriver heads.

When the rotary driver (20) is driven by the power tool, the hammer frame (31) will rotate with the rotary driver (20) to make the hammers (32, 32B, 32A) rotate and engage the anvils (41) of the output axle (40, 40A).

Figure 3:
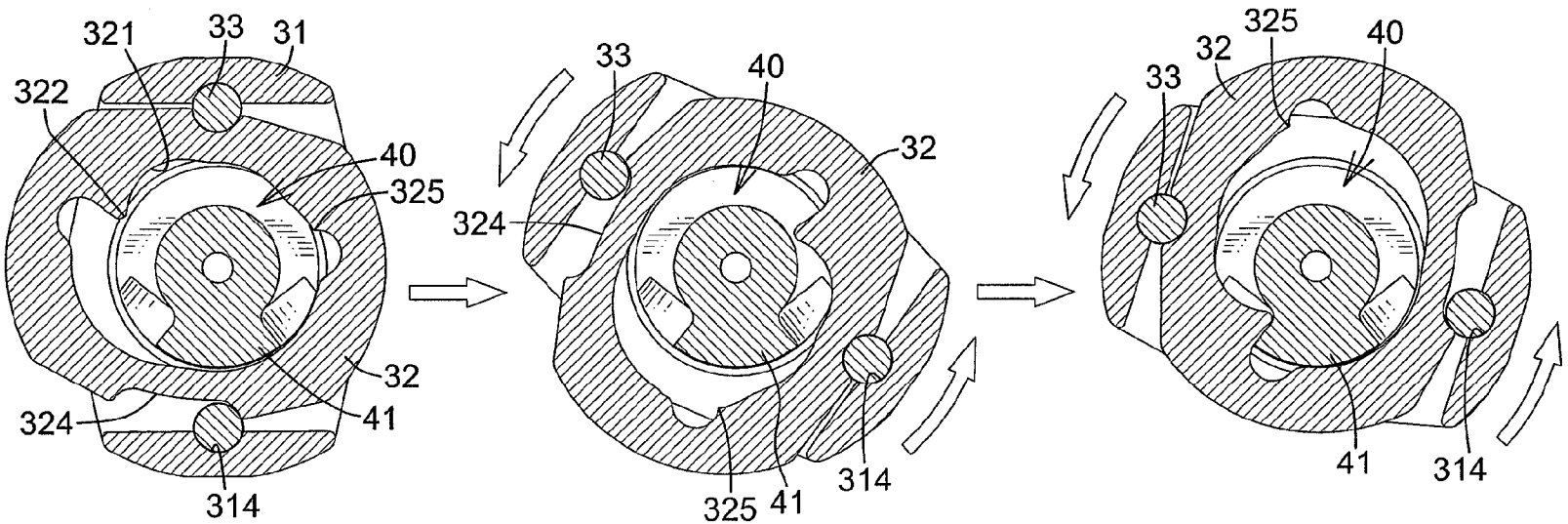
FIGS. 3 and 4 are operation rear views of the impact assembly in FIG. 1 being operated in a counter-clockwise direction.
Figure 4:
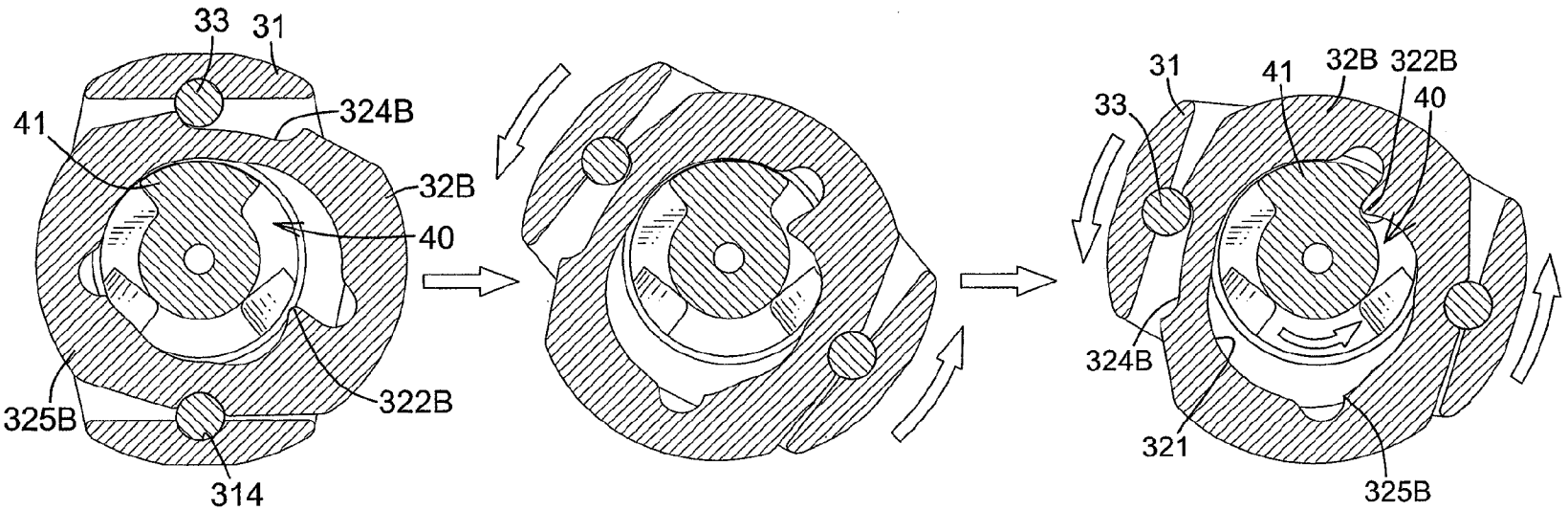

With further reference to FIGS. 3 and 4, the rotary driver (20) rotates the hammer frame (31) counter-clockwise (from a rear perspective) to loosen a bolt or a nut. The hammers (32, 32A, 32B) freely rotate relative to the output axle (40, 40A) and when the loosening protrusion (322, 322B) of each hammer (32, 32A, 32B) impacts the anvil (41) on the output axle (40, 40A), the output axle (40, 40A) will be driven to rotate with the hammer frame (31) and the tool head sleeve on the output axle (40, 40A) loosens the fastener.

Figure 5:
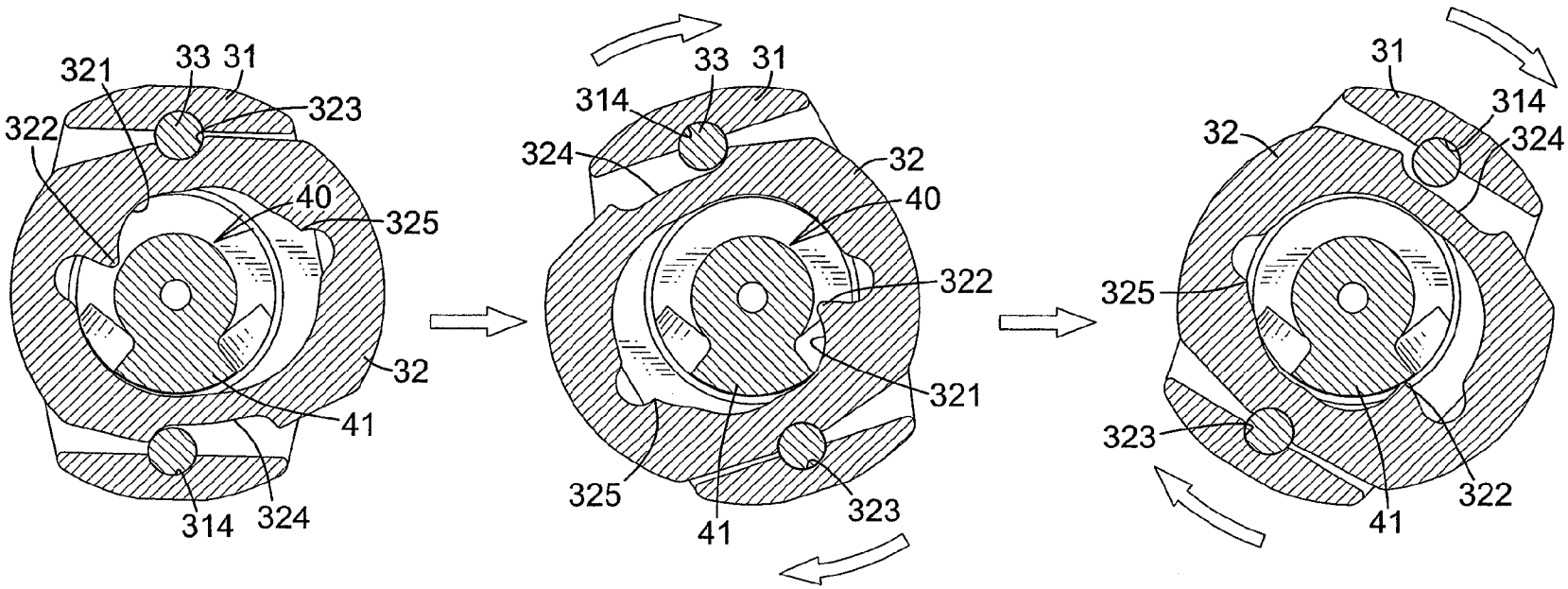
FIGS. 5 and 6 are the operation rear views of the impact assembly in FIG. 1 being operated in a clockwise direction.
Figure 6:
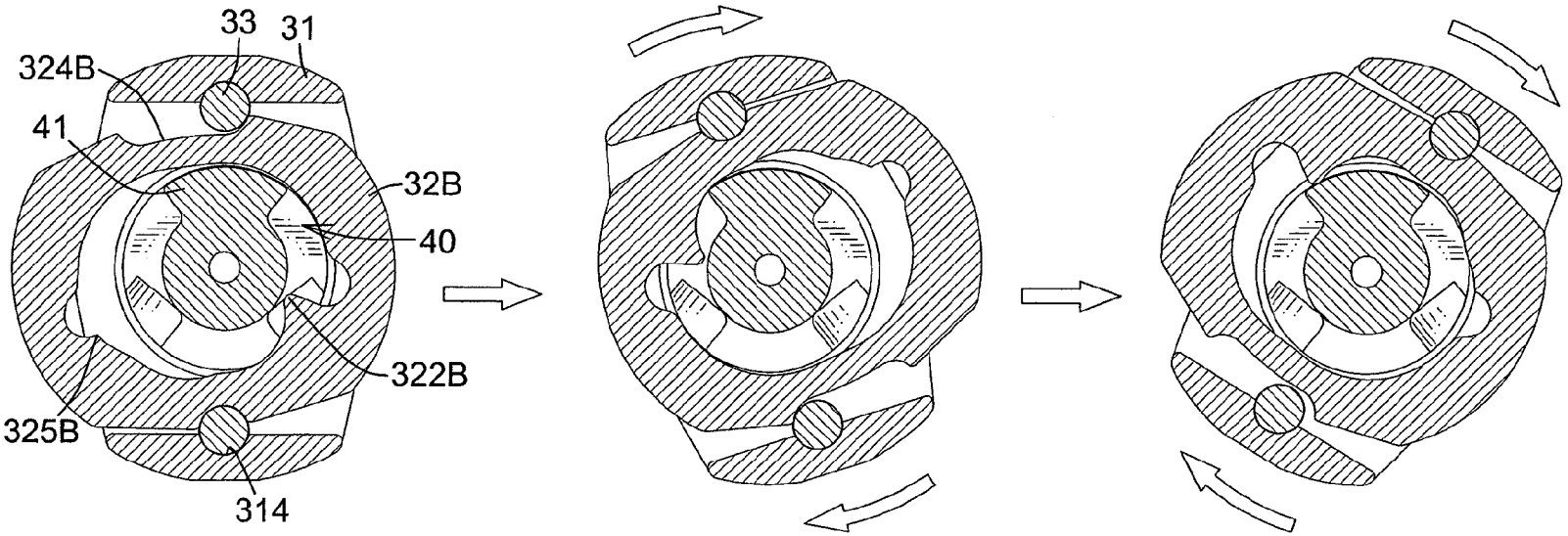
Figure 7:
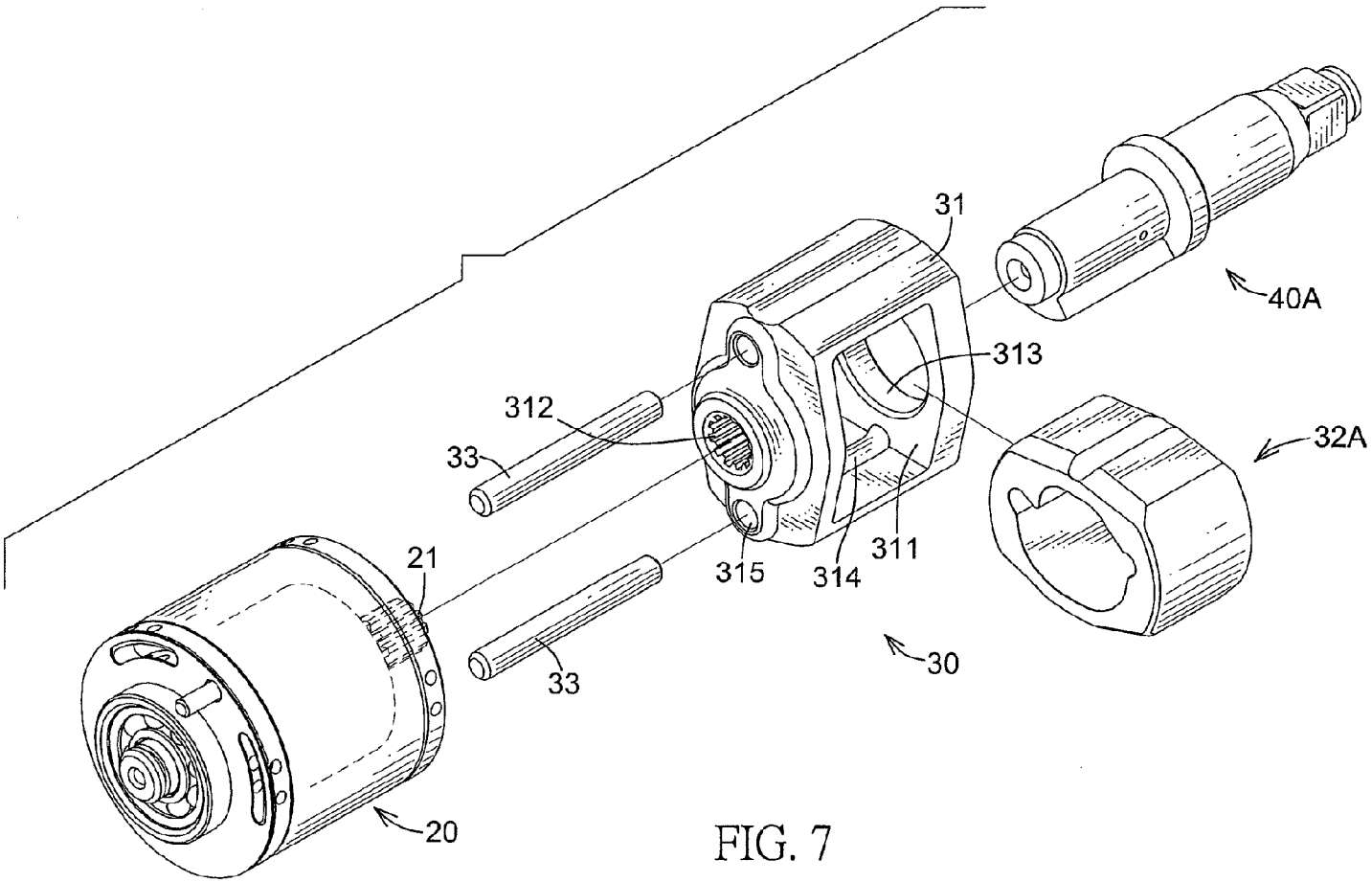
FIG. 7 is an exploded perspective view of another embodiment of an impact assembly in accordance with the present invention.
Figure 8:
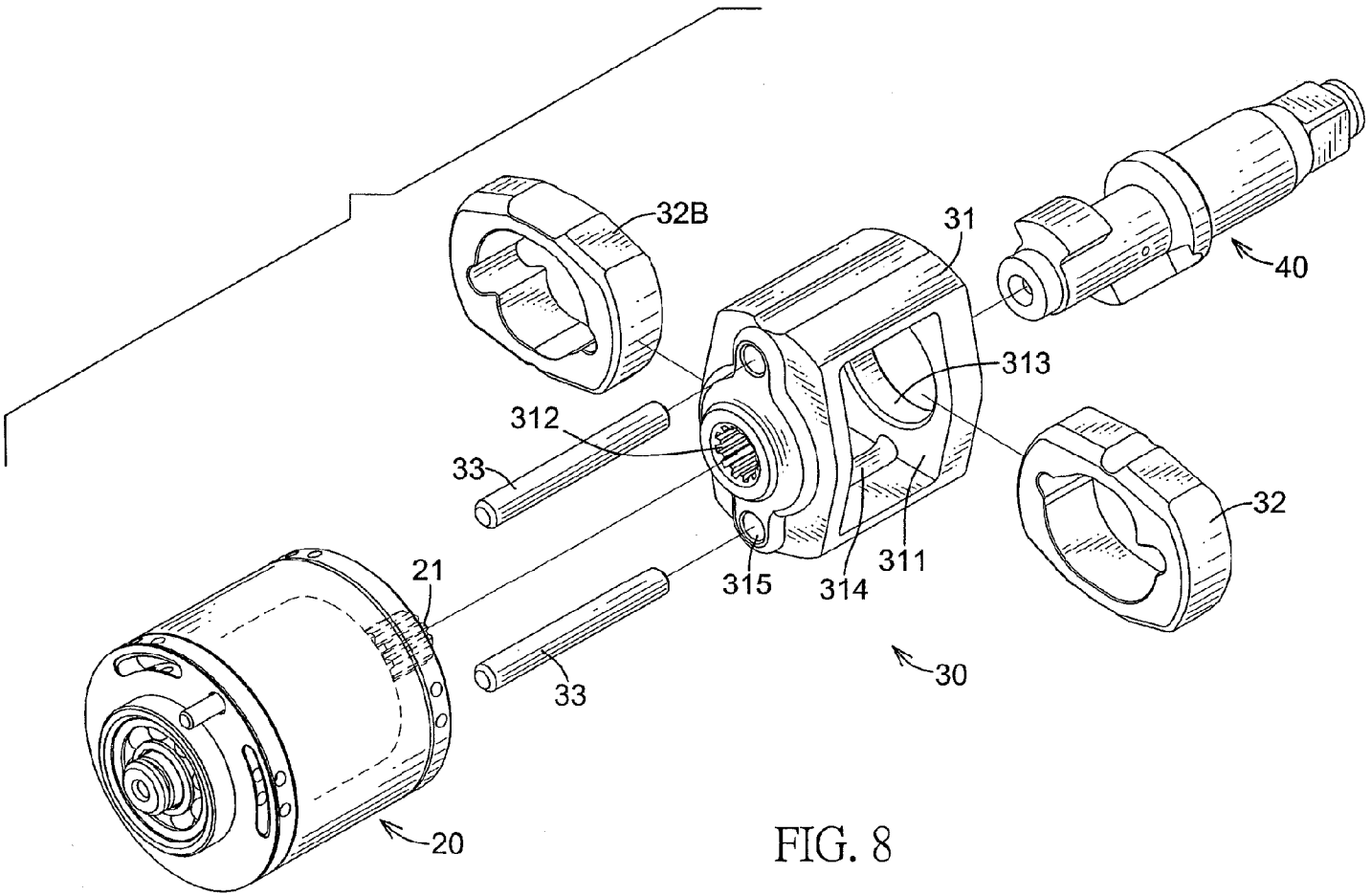
FIG. 8 is an exploded perspective view of a further embodiment of an impact assembly in accordance with the present invention.
Figure 9:
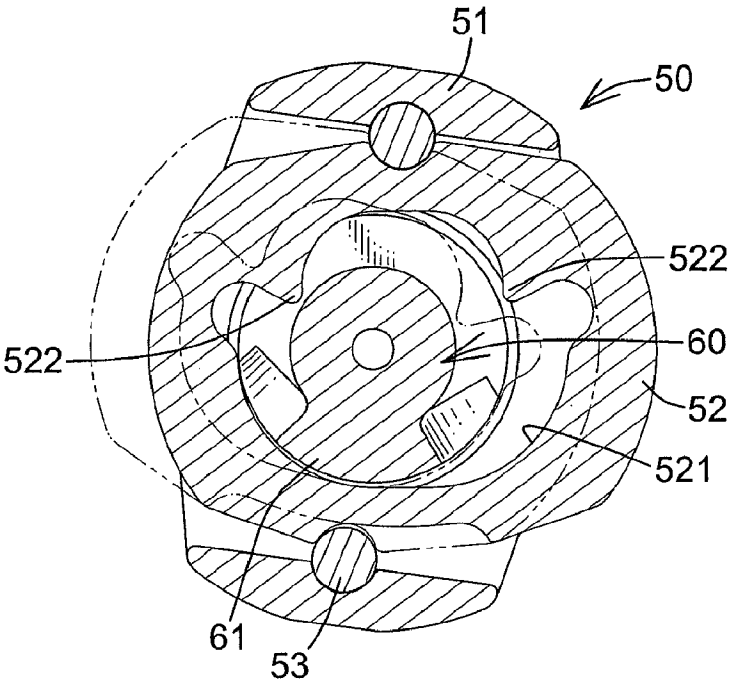
FIG. 9 PRIOR ART
FIG. 9 is an operational front view of a conventional impact assembly in accordance with the prior art.

With further reference to FIGS. 5 and 6, when the rotary driver (20) is driven clockwise (from a rear perspective), the hammers (32, 32A, 32B) freely rotate relative to the output axle (40, 40A). The anvils (41) on the output axle (40, 40A), since the tightening protrusions (325, 325B) are smaller than the loosening protrusions (322), and the anvils (41) of the output axle (40, 40A) cannot engage the tightening protrusions (325) firmly, the tightening pounds of torsion provides by the tightening protrusions (325, 325B) engaging the anvils (41) is smaller than the loosening pounds of torsion provided by the loosening protrusions (322, 322B) engaging each anvil (41) of the output axle (40, 40A) and the output axle (40) is rotated clockwise to tighten the bolt or the nut.

The impact assembly of the present invention may be implemented in a power tool used to tighten wheel nuts or bolts on vehicles. The power tool is used to tighten the wheel nut or bolt, but even when operated multiple times, the wheel nut or bolt will not be over tightened. Therefore, tightening of the wheel nut or bolt needs finishing off with a standard torsion wrench and the wheel nuts or bolts are accurately tightened to specifications, laws or regulations. Furthermore, impact assembly prevents the power tool from over-tightening the wheel nut or bolt and stripping the head from the nut or the bolt and meets safety standards, laws or regulations for each country.

However, when operated counter-clockwise, to loosen the wheel nut or bolt, the impact assembly delivers higher maximum pounds of torque and can remove a tightened wheel nut or bolt conveniently and efficiently.

Even though numerous characteristics and advantages of the present invention have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An impact assembly for a power tool having a chamber and a handle and a rotary driver being mounted in the chamber near the handle and having a driving shaft, the impact assembly comprising a hammer frame being mounted in the chamber and being connected to the rotary driver and having a front wall;

a rear wall;

a mounting recess being formed in the hammer frame between the walls and having two opposite inner sides; and a through hole being formed centrally in the front wall of the hammer frame;

at least one hammer being mounted pivotally in the mounting recess of the hammer frame between the walls and each one of the at least one hammer having a center;

an external surface;

an engaging hole being defined through the center of the hammer and having an inner surface;

a loosening protrusion being formed on the inner surface of the engaging hole in the hammer; and a tightening protrusion being formed on the inner surface of the engaging hole, being smaller than the loosening protrusion;

two hammer pins being mounted in the hammer frame to pivotally connect the at least one hammer to the hammer frame; and an output axle being mounted in the hammer frame and the engaging hole in the each one of the at least one hammer and protruding out through the through hole and having an external surface;

a hammer end;

an outer end; and at least one anvil being formed on the external surface of the output axle near the hammer end and selectively abutting the loosening and tightening protrusions.

2. The impact assembly for a power tool as claimed in claim 1, wherein the impact assembly has two hammers being inversely mounted in the hammer frame; and the output axle has two anvils being oppositely formed on and diametrically protruding staggered from the external surface of the output axle and respectively abutting selectively the loosening and tightening protrusions on the hammers.

3. The impact assembly for a power tool as claimed in claim 2, wherein the hammer frame further has two pin mounts being formed through the rear wall of the hammer frame and respectively in the inner sides of the mounting recess;

each hammer further has an engaging groove being formed on the external surface of the hammer and aligning with a corresponding one of the pin mounts; and a sliding recess being formed on the external surface of the hammer opposite to the engaging groove and being mounted slidably on a corresponding pin mount; and the hammer pins are mounted respectively in the pin mounts, the sliding recesses and the engaging grooves of the hammers.

4. The impact assembly for a power tool as claimed in claim 3, wherein the hammer frame further comprises a driver mount being formed centrally in the rear wall of the hammer frame and being adapted to connect to the driving shaft.

5. The impact assembly for a power tool as claimed in claim 1, wherein the hammer frame further comprises a driver mount being formed centrally in the rear wall of the hammer frame and being adapted to connect to the driving shaft.

* * * * *